US010327512B2

(12) United States Patent
Birrell

(10) Patent No.: US 10,327,512 B2
(45) Date of Patent: Jun. 25, 2019

(54) SHOE INSERT

(71) Applicant: Laura Birrell, Glasgow (GB)

(72) Inventor: Laura Birrell, Glasgow (GB)

( * ) Notice: Subject to any disclaimer, the term of this patent is extended or adjusted under 35 U.S.C. 154(b) by 0 days.

(21) Appl. No.: 15/320,001

(22) PCT Filed: Jun. 24, 2015

(86) PCT No.: PCT/GB2015/051843
§ 371 (c)(1),
(2) Date: Dec. 20, 2016

(87) PCT Pub. No.: WO2015/198048
PCT Pub. Date: Dec. 30, 2015

(65) Prior Publication Data

US 2017/0127762 A1 May 11, 2017

(30) Foreign Application Priority Data

Jun. 25, 2014 (GB) ..... 1411317.9

(51) Int. Cl.
*A43B 7/14* (2006.01)
*A43B 23/28* (2006.01)
*A43B 1/00* (2006.01)

(52) U.S. Cl.
CPC ..... *A43B 23/28* (2013.01); *A43B 1/0081* (2013.01); *A43B 7/1465* (2013.01)

(58) Field of Classification Search
CPC .. A43B 1/0081; A43B 23/28; C09J 2201/128; Y10T 428/24017
USPC ..... 36/58.5, 58.6, 71
See application file for complete search history.

(56) References Cited

U.S. PATENT DOCUMENTS 1,155,209 A * 9/1915 Burke ..... A43B 23/28 36/58.5
2,311,925 A * 2/1943 Boos ..... A43B 7/142 36/163
4,165,555 A * 8/1979 Boxer ..... A41B 11/002 209/937

(Continued)

FOREIGN PATENT DOCUMENTS

FR 2539966 8/1984
FR 2901671 12/2007

(Continued)

*Primary Examiner* — Ted Kavanaugh
(74) *Attorney, Agent, or Firm* — Dorton & Willis LLP; Ryan Willis

(57) ABSTRACT

A footwear insert comprising an insert member, the insert member comprising a first surface and a second surface, the first surface opposing the second surface, the first surface comprising a releasable attachment for an internal portion of footwear and the second surface comprising a releasable attachment for a foot. The insert may be a heel insert. There is also provided a kit comprising: a) a first insert member; and b) two or more second insert members, and a kit comprising two or more second insert members. The presence of a second surface with a releasable attachment to the foot means that the foot is indirectly attached to the inside of the footwear via the insert member and its attachment to the footwear. This impedes the foot slipping from the footwear and prevents movement of the foot against the insert member.

18 Claims, 7 Drawing Sheets

(56) References Cited

U.S. PATENT DOCUMENTS

| | | | | |
|---|---|---|---|---|
| 5,842,292 | A * | 12/1998 | Siesel | A43B 23/28 36/58.5 |
| 6,000,147 | A | 12/1999 | Kellerman | |
| 6,692,807 | B2 * | 2/2004 | Bries | C09J 7/20 428/40.1 |
| 2008/0301860 | A1 * | 12/2008 | Iqbal | A41D 13/0562 2/455 |
| 2010/0018082 | A1 * | 1/2010 | Stokes | A43B 7/16 36/36 R |
| 2010/0024248 | A1 * | 2/2010 | Baker | A43B 3/0031 36/97 |
| 2010/0224312 | A1 * | 9/2010 | Tsubaki | B32B 37/0015 156/212 |
| 2013/0269218 | A1 | 10/2013 | Blumenaus | |

FOREIGN PATENT DOCUMENTS

| | | |
|---|---|---|
| WO | 2008031141 | 3/2008 |
| WO | 2010011992 | 1/2010 |
| WO | 2012173986 | 12/2012 |
| WO | 2013063341 | 5/2013 |
| WO | 2015198048 | 10/2015 |
| WO | 2015198048 | 12/2015 |

* cited by examiner

SHOE INSERT

FIELD OF THE INVENTION

The invention relates to an insert for footwear, in particular a shoe insert, for impeding a foot slipping out of the footwear as well as a kit comprising such inserts. In a further aspect, the invention also comprises use of such an insert. In one aspect the invention relates to a contact fastener, in particular a heel contact fastener.

BACKGROUND TO THE INVENTION

Shoes, for example those without straps such as court shoes, have a tendency, in use, to slip from the foot of the wearer. This slipping is an inconvenience and can cause blisters to form on the foot, in particular the heel.

Products on the market which address this problem include "Party Heels®" by Scholl. This product is a heel shield made from a firm gel which has an adhesive surface on one side of the gel to stick to the inside of a shoe. The product helps prevent slipping as the gel shield has a certain volume, which reduces the volume for the foot in the shoe.

However, shoes often still slip with such volume-reducing products. Furthermore, the products currently on the market have a tendency to lose their attachment to the shoe and either move around in the shoe, or fall out of the shoe altogether.

Therefore, further non-slip products for impeding a foot slipping from a shoe are needed. Also, it would be desirable to provide a contact fastener for fastening a shoe to the heel of a wearer.

SUMMARY OF THE INVENTION

At its most general, the invention proposes a footwear insert comprising an insert member, the insert member comprising a first surface and a second surface, the first surface opposing the second surface, the first surface comprising a releasable attachment for an internal portion of footwear and the second surface comprising a releasable attachment for a foot.

The presence of a second surface with a releasable attachment to the foot means that the foot is indirectly attached to the inside of the footwear via the insert member and its attachment to the footwear. This impedes the foot slipping from the footwear. Additionally, as the foot is attached to the insert member, this prevents movement of the foot against the insert member. Such friction against the insert member can dislodge the attachment between the insert member and the footwear. Therefore, the insert member having a second surface with a releasable attachment to the foot also helps prevent the insert member unsticking, or becoming dislodged, from the inside of the footwear. Suitably, the releasable attachment to the foot may be or may have an adhesive portion or surface to allow the insert member to releasably adhere to the foot or, for example socks, tights or the like. Alternatively, the releasable attachment to the foot may be provided by material comprising entangling protrusions, for example a material comprising hooks which can releasably attach to sock, tights or the like by entanglement with the material of the socks, tights or the like.

According to a first aspect of the invention, the footwear insert can comprise a first insert member and a second insert member, the first insert member comprising a first surface and a second surface, the first surface opposing the second surface and having a releasable attachment for an internal portion of footwear;

the second insert member comprising a first surface and a second surface, the first surface opposing the second surface and having a releasable attachment to a foot, wherein, in use, a releasable attachment is formed between the second surface of the first insert member and the second surface of the second insert member.

The introduction of a second insert member provides for reusability of the insert in that the first insert member can remain in place attached to the footwear (via the first surface of the first insert member) for more than one wear of the shoe. This minimises repeated removal of the insert from the footwear which may cause damage to the footwear. The second insert member can be replaced after every wear or less regularly. A first insert member may then be used to attach to different second insert members.

In embodiments the releasable attachments of the first and/or second insert members may comprise an adhesive surface. In embodiments by releasable attachment can be meant an attachment that temporarily binds two surfaces to each other, for example that can temporarily bind two surfaces together for at least 1 hour, at least 5 hours, at least 8 hours, at least 24 hours, at least 5 days, at least 1 week, at least one month. As will be understood, different attachments, for example different adhesives may be utilised, to achieve temporary binding for desired periods of time. Additionally, different attachments can be utilised to allow release of the attachments by application of force, for example different degrees of pulling force, to break the releasable attachment as required by the user.

For example, the first surface of the first insert member may comprise an adhesive surface and/or the first surface of the second insert member may comprise an adhesive surface. The adhesive surface may be an adhesive layer that spans the surface of the member. Alternatively, the adhesive surface may be a discrete patch or strip of adhesive on the surface of the member, or multiple discrete patches or strips on the surface of the member.

The releasable attachments may have protective coverings or backings which are removed immediately prior to use. For example, where the releasable attachments are adhesive surfaces, the protective coverings or backings prevent these surfaces from attaching to other objects prior to use and in doing so, maintain the adhesive layer ready for use.

Suitably, an adhesive may be an adhesive as known in the art to attach material to the skin, for example to attach a plaster to the skin. Suitably, an adhesive to attach a first surface of a first insert member to footwear may be a known adhesive in the art. In embodiments, the releasable attachment formed between the first and second insert members can comprise an adhesive, a magnetic attachment, surface modulations provided on the second surfaces of the first and second members which allow the first and second members to interlock with each other, material comprising entangling protrusions and or loops (for example Velcro™) or combinations thereof.

The first and/or second insert member may comprise a hook layer and/or a loop layer, which only partially covers the second surface of the first and/or second insert member. The first and/or second insert member may comprise a gap between the hook layer and/or the loop layer and the perimeter of the first and/or second insert member, in which there are no hooks and/or loops.

The releasable attachment between the second surface of the first insert member and the second surface of the second insert member may be flexible. A flexible releasable attachment allows the first and second insert members to move relative to each other. This flexibility has the following advantages: a) it allows the second insert member to move with the foot preventing unsticking or dislodging of the releasable attachment of the first surface of the second insert member from the foot; and b) it absorbs the movement of the foot therefore preventing such movement dislodging the releasable attachment of the first surface of the first insert member from the internal portion of the footwear.

The releasable attachment between the second surface of the first insert member and the second surface of the second insert member may comprise a protrusion(s) with a complementary hole(s). A releasable attachment with a fine protrusion(s) allows a user to wear for example, stockings, tights, or socks with the footwear. Where the releasable attachment between the second surface of the first insert member and second surface of the second insert member is a protrusion (s) and complementary hole(s), the protrusions can pierce, for example, a mesh of a material covering the foot, for example stocking or tight material without damaging the stocking or tights and engage with the complementary holes on the other side of the mesh.

For example, the second surface of the first insert member may comprise a surface having at least one protrusion, typically a plurality of protrusions. The second surface of the second insert member may have a complementary surface having at least one complementary hole, typically a plurality of complementary holes to the protrusions. After applying the first insert member to the internal portion of footwear, and applying the second insert member to the foot, the wearer can put on tights over the second insert member. On stepping into the footwear where the first insert member has been applied, the protrusion(s) of the second surface of the first insert member can pierce the tights and engage the hole(s) on the second surface of the second insert member, e.g. by way of a friction fit. Suitably, this may form a releasable attachment between the first insert member and the second insert member through the tights.

The protrusions may allow the insert to be worn with various denier tights. For example, the protrusions may pierce the mesh of 10 denier, 20 denier, 30 denier, 40 denier, 50 denier, 60 denier, 70 denier, 80 denier, 90 denier or 100 denier tights.

The protrusions may be at least 1 mm in length. The protrusions may be in the range 0.4 mm to 4 mm in length, suitably, 0.4 mm, 0.6 mm, 0.8 mm, 1 mm, 1.2 mm, 1.4 mm, 1.6 mm, 2 mm, 2.2 mm, 2.4 mm, 2.6 mm, 2.8 mm, 3 mm, 3.2 mm, 3.4 mm, 3.6 mm, 3.8 mm or 4 mm in length.

The releasable attachment between the second and first insert member may also comprise a hook-and-loop fastener. Hook-and-loop fasteners typically consist of two components: one component features hooks; the second component features loops. When the two components are pressed together, the hooks catch in the loops and the two pieces fasten or bind temporarily while pressed together. The hooks can be released from the loops by application of force by a user to pull the hooks from the loops. An example of such a fastener is Velcro™. The hook-and-loop fastener may also allow the wearing of tights with the insert, the hoop and loop attachment forming through the mesh of the tights in a similar manner as explained above for protrusions with complementary holes. For example, the second surface on the first member may comprise a hook means, and the second surface of the second insert member may comprise a complementary loop surface.

In the examples given, the insert can be worn under or over tights or socks, where the second insert member is worn under or over the tights or socks.

The first and/or second insert member may be flexible along their lengths. The length of the first and second member can be considered as the direction which in use, lies horizontally around the heel.

The first and/or second insert member may be flexible across their widths. The width of the first and second member can be considered as the direction which in use, lies vertically in line with the heel.

The first and/or second insert member may be flexible across the foot. This can be defined as movement in a plane parallel to the skin of the foot.

Flexibility of the first and/or second insert members themselves has the same advantages as a flexible releasable attachment between the first and second insert members. That is, it allows the insert members to move relative to each other. Therefore, it allows: a) the second insert member to move with the foot preventing unsticking or dislodging of the releasable attachment of the first surface of the second insert member from the foot; and b) it absorbs the movement of the foot therefore preventing such movement dislodging the releasable attachment of the first surface of the first insert member from the internal portion of the footwear.

Thus flexibility of the first and/or second members also prevents the foot from slipping from the footwear by keeping the second insert member attached to the foot, and by preventing the insert from becoming dislodged by keeping the first insert member attached to the internal portion of the footwear.

Suitably, the first and/or second member may comprise an elastomeric material. For example, the insert portion may comprise a gel-like material or a foam-like material. The first and/or second insert member may comprise silicone and/or a foam or foam-like material, such as polyethylene foam. Such gel-like materials or foam-like materials and other flexible materials allow the insert member to be deformable such that when in use, the insert member can move with the foot. This prevents the second insert member unsticking from the foot. By effectively absorbing the movement of the foot, the flexible insert portion also prevents movement of the foot dislodging the first insert member and its attachment from the footwear.

The first and/or second insert members may comprise a fabric material. In embodiments a first insert member can comprise a gel-like material or a foam-like material and a second insert member can comprise a fabric material, for example an elasticated fabric material.

The first and/or second insert member may also comprise a resilient material to provide cushioning for comfort and/or to reduce the volume in the footwear. Cushioning allows movement of the foot against the insert. Movement against the insert can be defined as movement along the axis between the heel and the toes. Alongside the insert having a second insert member with a releasable attachment to the foot, the reduction in volume of the shoe where the insert is cushioned further prevents the shoe from slipping from the foot. The first and/or second insert members may comprise a gel-like material or a foam-like material, the gel or foam providing such cushioning. The first and/or second insert members may comprise silicone, or a foam or foam-like material, such as polyethylene foam.

The first and/or second insert member may comprise a first edge and a second edge, which optionally have a similar circumferential profile.

The second edge may be shorter than the first edge.

The second edge and the first edge may be connected by auriform or arcuate edges.

The first and/or second insert member may comprise a notch in the first edge and/or the second edge, optionally a V-shaped notch and/or a U-shaped notch.

The notch may be substantially in the centre of the first edge and/or the second edge.

The first and/or second insert member may be lobe-shaped or wing-shaped. The first and/or second insert member may comprise one or more lobe-shaped or wing-shaped sections.

The first and/or second members may be transparent. Alternatively, the first and/or second members may be skin-coloured. The first and/or second members may be black, brown or tan-coloured.

The insert may be a heel insert. For example, the first and second insert members of the insert may be oblong in shape. The large diameter of the oblong may span the back of the heel. The large diameter may be 2 cm, 3 cm, 4 cm, 5 cm, 6 cm, 7 cm, 8 cm, 9 cm 10 cm or 11 cm in length. The first insert member may be shaped so as to be mouldable to the internal heel of the footwear. The second insert member may be shaped so as to be mouldable to the heel of the foot.

For example, the second insert member may be arched to follow the natural indentation of the foot around the heel. The span of the arch may be 2 cm, 3 cm, 4 cm, 5 cm, 6 cm, 7 cm, 8 cm, 9 cm, 10 cm, 11 cm, 12 cm, 13 cm, 14 cm, 15 cm, 16 cm, 17 cm or 18 cm to span from one side of the foot to the other side of the foot. The height of the arch (from the line spanning the two hinges of the arch to the point of the arch) may be 2 cm, 3 cm, 4 cm, 5 cm, 6 cm or 7 cm to curve around the top of the heel. The width of the second insert member may be 1 cm, 2 cm, 3 cm, 4 cm or 5 cm. For example, the second insert member may be arcuate, banana or boomerang-shaped.

The first insert member may be complementary in shape to the second insert member to allow formation of the releasable attachment between the first and second members.

According to a second aspect there is provided a kit comprising:

a) a first insert member; and b) two or more second insert members;

the first insert member comprising a first surface and a second surface, the first surface opposing the first surface and having a releasable attachment for an internal portion of footwear;

the two or more second insert members each comprising a first surface and a second surface, the first surface opposing the second surface and having a releasable attachment for a foot, wherein, in use, the second surface of the first insert member and the second surface of the second insert member form between them a releasable attachment.

In a third aspect of the invention, there is provided a kit comprising two or more second insert members of the kit of the second aspect of the invention. The first and second insert members of the above kits may be as described in the first aspect for the insert.

The present invention may also be expressed as use of the insert described above in footwear for impeding a foot slipping out of the shoe.

BRIEF DESCRIPTION OF THE DRAWINGS

Examples of the invention are described below, by way of example only, with reference to the accompanying drawings, in which.

DETAILED DESCRIPTION

Figure 1:
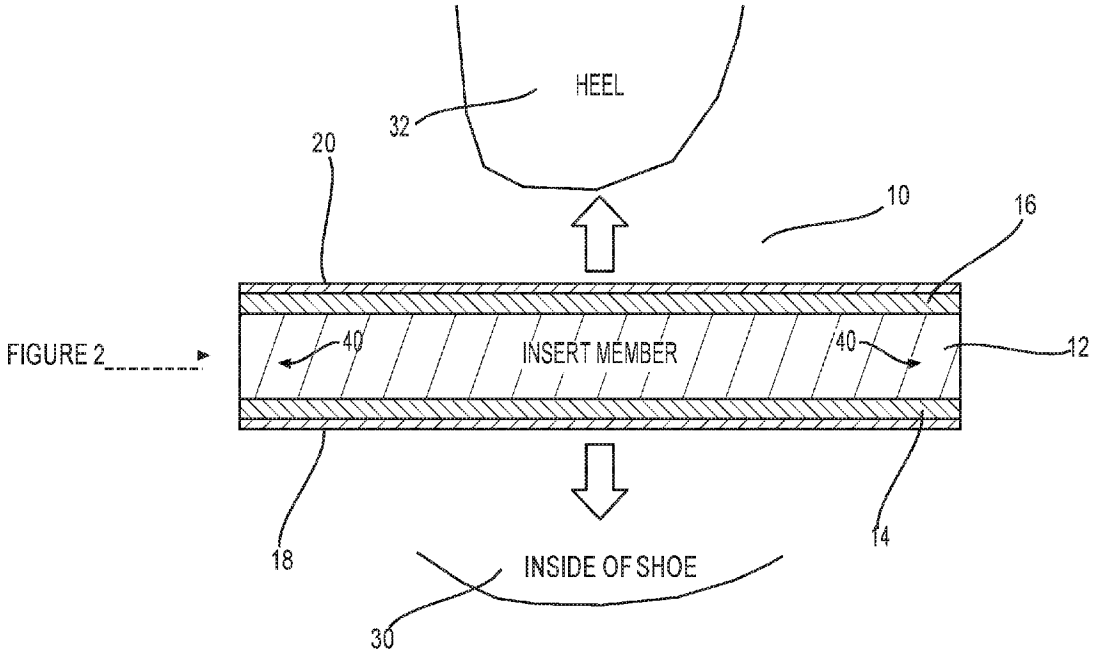
FIG. 1 is a schematic drawing of a footwear insert that is an embodiment of the invention. The drawing showing an enlarged diagrammatic view of the insert relative to the heel and shoe when the insert would be in use.

FIG. 1 shows a footwear insert 10 that is an embodiment of the invention. The insert 10 has an insert member 12 with an adhesive first surface, layer 14, for attaching the insert member to an internal portion of the shoe 30. The insert also has a second adhesive surface, layer 16, for attaching the insert member to the heel 32 of the wearer. Prior to use, the adhesive layers 14 and 16 are protected by backings 18 and 20. In use, the wearer removes the backing 18 and applies the adhesive layer 14 to the inside of the shoe 30. The insert member 10 moulds to the inside of the shoe. Before putting their foot into the shoe, the wearer removes the backing 20 from the other adhesive surface 16. The wearer then inserts their foot into the shoe and the adhesive surface 16 attaches to the heel 32 of the wearer. Thus, the foot of the wearer is attached to the shoe via the insert member and its releasable attachments. In use the insert member is flexible across the foot, for example, flexible/deformable in the horizontal plane, as shown by the arrows 40 and/or in the vertical plane. This allows the insert member 12 and therefore the adhesive surface 16 to move with the foot and therefore prevents the adhesive surface 16 from unsticking from the foot. This flexibility means that movement of the foot is absorbed by the flexible insert member 12. As a result, movement of the foot does not pull the adhesive surface 14 from the shoe. The insert member may also be flexible/deformable across the thickness of the insert, such that cushioning is provided to the heel relative to the inside of the shoe.

Figure 2:
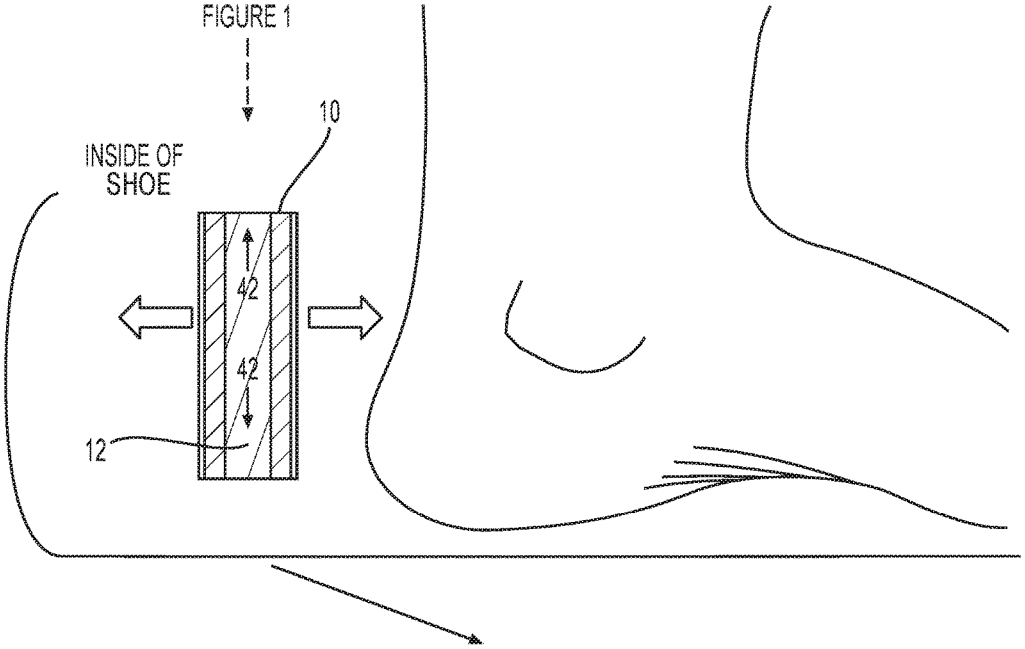
FIG. 2 is a schematic drawing of the insert of FIG. 1 along the direction shown in FIG. 1.

FIG. 2 shows a side view of the insert 10 of FIG. 1. This view shows the flexibility of the insert across the heel of the foot in the vertical plane as shown by the arrows 42. As for the flexibility/deformability in the horizontal plane, this freedom of movement in the vertical plane prevents the foot unsticking from the insert 10, and the insert 10 from unsticking from the inside of the shoe.

Figure 3:
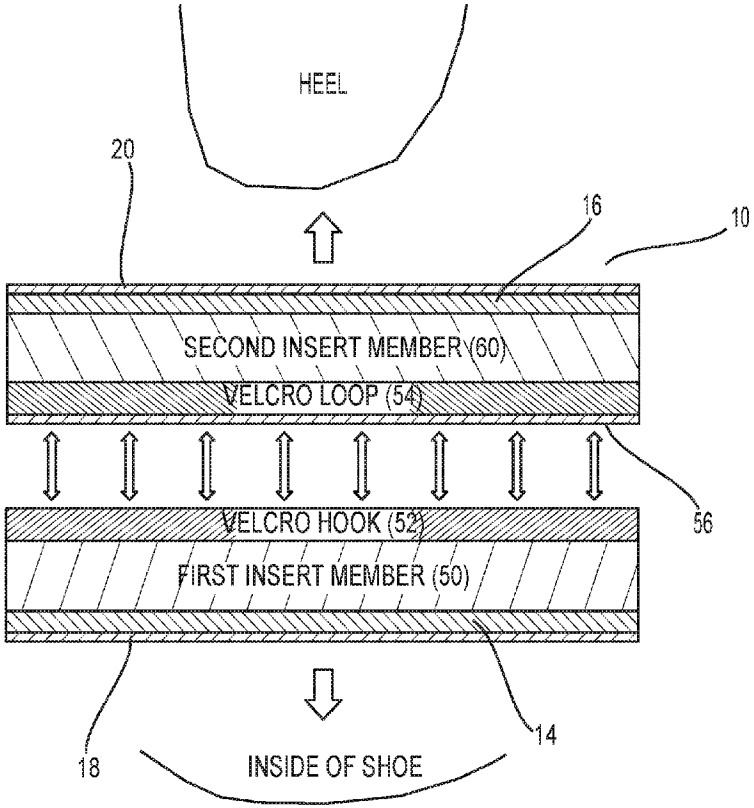
FIG. 3 is a schematic drawing of a footwear insert in use that is a further embodiment of the invention.

FIG. 3 shows an insert that is a further embodiment of the invention. The insert 10 has a first insert member 50 with a first adhesive surface 14 which, when the protective backing 18 is removed, allows the first insert member to be attached to the inside of the shoe. The insert also has a second insert member 60 which has a first adhesive surface 16 which when the protective backing 20 is removed, allows the second insert member to be attachable to the heel of the wearer. The first insert member and the second insert member attach to each other via a hoop and loop fastener. The fastener is a hook and loop fastening system, for example Velcro™. The first insert member has a Velcro™ hook layer 52 which in use attaches to the Velcro™ loop layer 54 of the second insert member 60. In use, the wearer removes the protective backing 18 of the first insert member 50 and affixes the first insert member to the inside of the shoe. The wearer then removes the protective backing 20 from the second insert member 60 and affixes the first adhesive surface 16 to their heel. The wearer may remove an optional protective backing 56 of the Velcro™ loop layer 54 and then insert their foot into the shoe whereupon the Velcro™ loop layer 54 forms a releasable attachment with the Velcro™ hook layer 52 thus forming a releasable attachment between the first insert member and the second insert member. The flexibility of the Velcro™ attachment between the first insert member 50 and the second insert member 60 allows movement of the second insert member and its first adhesive surface 16 to move with the foot preventing the adhesive surface 16 from unsticking from the foot. The flexible Velcro™ attachment 52 and 54 also absorbs the movement of the foot preventing the foot moving directly against the insert, such movement being a cause of the adhesive surface 14 unsticking and becoming dislodged from the internal portion of the shoe. An additional benefit of the insert having a second insert member is that it allows for re-usability in that the first insert member can remain attached to the shoe for multiple wears, with just the second insert member being replaced at each wear.

Figure 4:
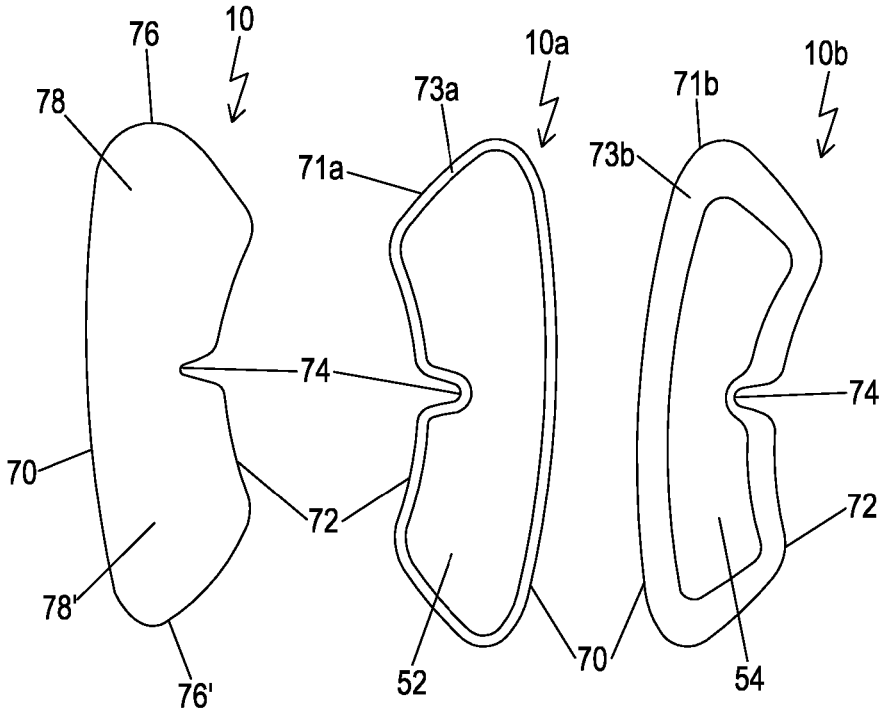
FIG. 4 is an image of an embodiment of the invention.

FIG. 4 shows an image of an insert 10 of the invention, having a first insert member 10*a* and a second insert member 10*b*. The first insert member 10*a* is shown with a Velcro™ hook layer 52. The second insert member 10*b* is shown with a Velcro™ loop layer 54.

As shown, the shape of the insert member 10 is generally arcuate and is generally symmetrical along at least one axis. The insert member 10 has a first edge (or outer edge) 70 and a second edge (or inner edge) 72, which have a similar circumferential profile. The second edge 72 has a V-shaped or U-shaped notch 74 located substantially in the centre of the second edge 72, such that the insert appears symmetrical. The second edge 72 is shorter than the first edge 70, and the second edge 72 and the first edge 70 are connected by auriform or arcuate edges 76, 76' to provide lobe-shaped or wing-shaped sections 78, 78'.

In use, the insert 10 can be orientated such that the V-shaped or U-shaped notch 74 is either at the top or the bottom of the insert 10. The V-shaped or U-shaped notch 74 (in either orientation) provides flexibility to the insert 10 when placed in shoes or on foot. Also, it is found to prevent (or at least mitigate) the insert from folding on itself (i.e., bunching up). For example, the shape of the inside of the heel of a shoe can be narrower toward the foot opening, and thus pads that are fitted to the inside of the shoe can fold on themselves. The V-shaped or U-shaped notch 74 in the first insert member 10*a* is found to prevent (or at least mitigate) the first insert member 10*a* from folding on itself when attached to a shoe. Also, different people have different heel shapes. The V-shaped or U-shaped notch 74 in the second insert member 10*b* is found to better accommodate different heel shapes, again preventing (or at least mitigating) the second insert member 10*b* from folding on itself.

The Velcro™ hook layer 52 on the first insert member 10*a* is offset from the perimeter 71*a* of the first insert member 10*a*, there being a gap 73*a* between the perimeter 71*a* and the Velcro™ hook layer 52 in which there are no hooks. Thus, the surface of the first insert member 10*a* is only partially covered by the Velcro™ hook layer 52. The gap as illustrated is between approximately 0 mm and approximately 3 mm. However, the gap 73*a* may be approximately 20 mm, 19 mm, 18 mm, 17 mm, 16 mm, 15 mm, 14 mm, 13 mm, 12 mm, 11 mm, 10 mm, 9 mm, 8 mm, 7 mm, 6 mm, 5 mm, 4 mm, 3 mm, 2 mm, and/or 1 mm, or any range between these values (i.e., any range between 0 mm and 20 mm as defined using the values stated). The gap 73*a* may be a different size at different points.

The Velcro™ loop layer 54 on the second insert member 10*b* is offset from the perimeter 71*b* of the second insert member 10*b*, there being a gap 73*b* between the perimeter 71*b* and the Velcro™ loop layer 54 in which there are no loops. Thus, the surface of the second insert member 10*b* is only partially covered by the Velcro™ loop layer 54. The gap as illustrated is between approximately 3 mm and approximately 13 mm. However, the gap 73*b* may be approximately 20 mm, 19 mm, 18 mm, 17 mm, 16 mm, 15 mm, 14 mm, 13 mm, 12 mm, 11 mm, 10 mm, 9 mm, 8 mm, 7 mm, 6 mm, 5 mm, 4 mm, 3 mm, 2 mm, and/or 1 mm, or any range between these values (i.e., any range between 0 mm and 20 mm as defined using the values stated). The gap 73*b* may be a different size at different points.

The first insert member 10*a* is made from cross-linked closed cell polyethylene foam having a density of 33 $kgm^{-3}$ and a thickness of around 2 mm. Other suitable foams and foam-like materials can be used. Also, gels and gel-like materials can be used such as, for example, silicone. The second insert member 10*b* is made from spunlaced or spunlaid nonwoven fabric or similar.

The first insert member 10*a* and the second insert member 10*b* are similarly shaped so as to enable a releasable attachment to form between them.

The insert member 10 may be lobe-shaped or wing-shaped, or may have one or more lobe-shaped or wing-shaped sections.

The gaps between the perimeters and the hook and loop layers better allows a user to insert a finger between the first insert member and the second insert member, which makes it easier to separate the hook and loop layers, and therefore separate the first insert member and the second insert member.

Furthermore, the gaps between the perimeters and the hook and loop layers mitigates noise that is otherwise generated by the insert when in use. This can be a crunching noise generated by movement of the first insert member and the second insert member relative to one another.

Figure 5:
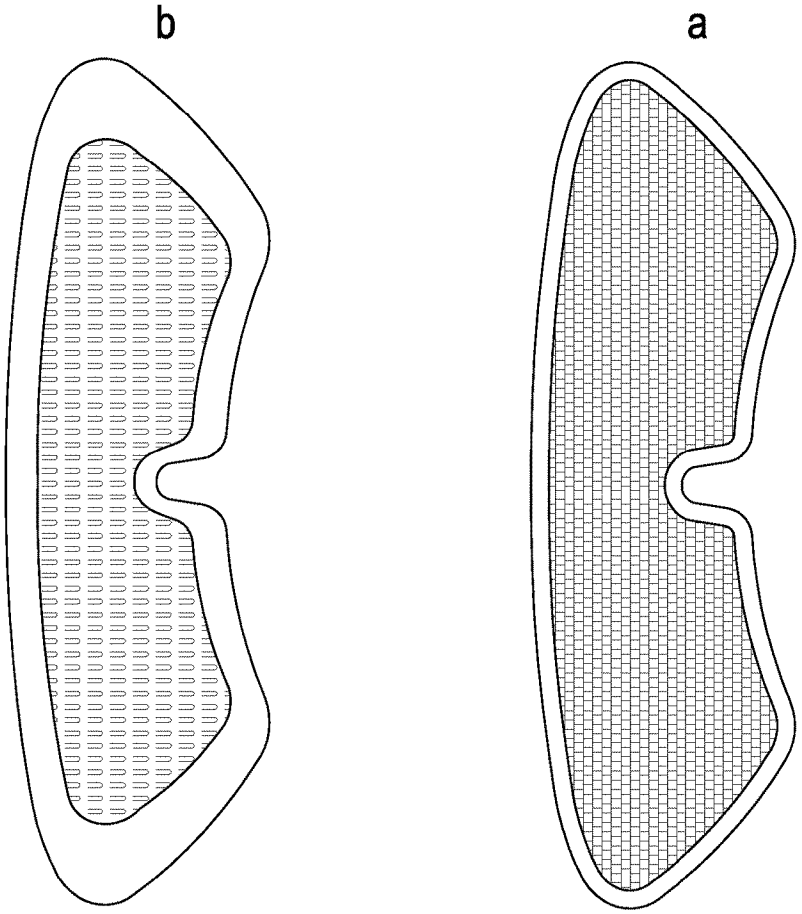
FIG. 5 is a photograph of an embodiment of the invention showing an arcuate, lobe or wing shape.

FIG. 5 shows a photograph of an insert of the invention. The first insert member (a) is shown with a Velcro™ hook layer. The second insert member (b) is shown with a Velcro™ loop layer.

Figure 6:
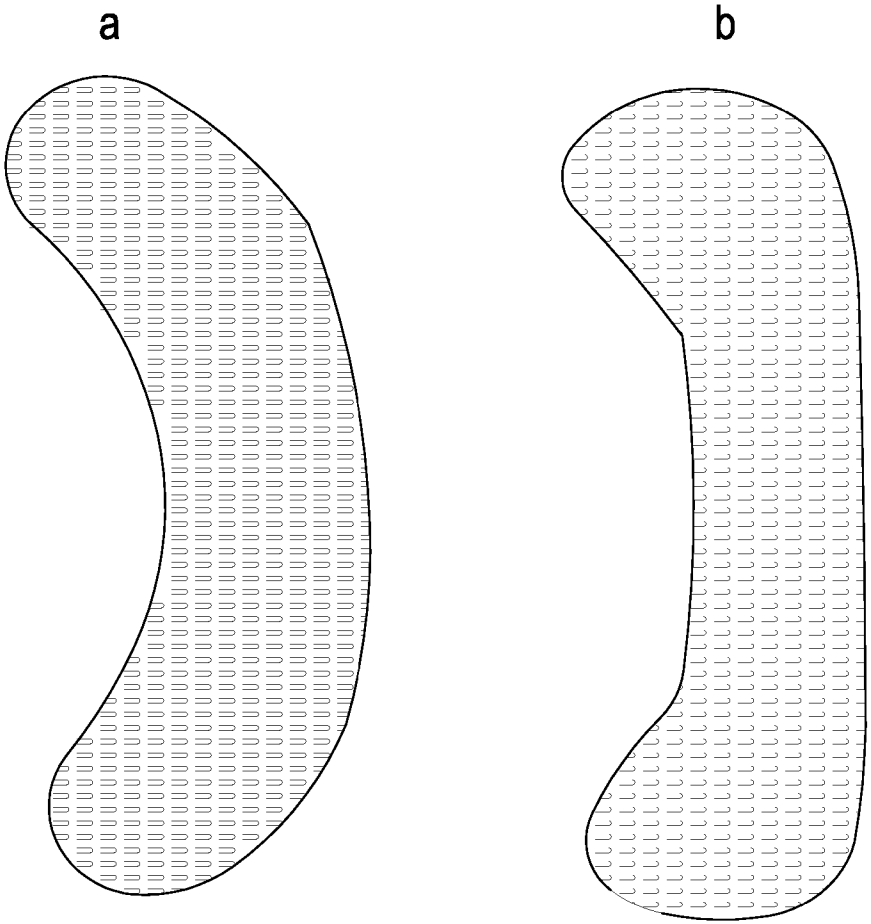
FIG. 6 is a photograph of an embodiment of the invention showing an arcuate, banana or boomerang shape.

FIG. 6 shows a photograph of an insert of the invention. The first insert member (a) is shown with a Velcro™ hook layer. The second insert member (b) is shown with a Velcro™ loop layer.

Figure 7:
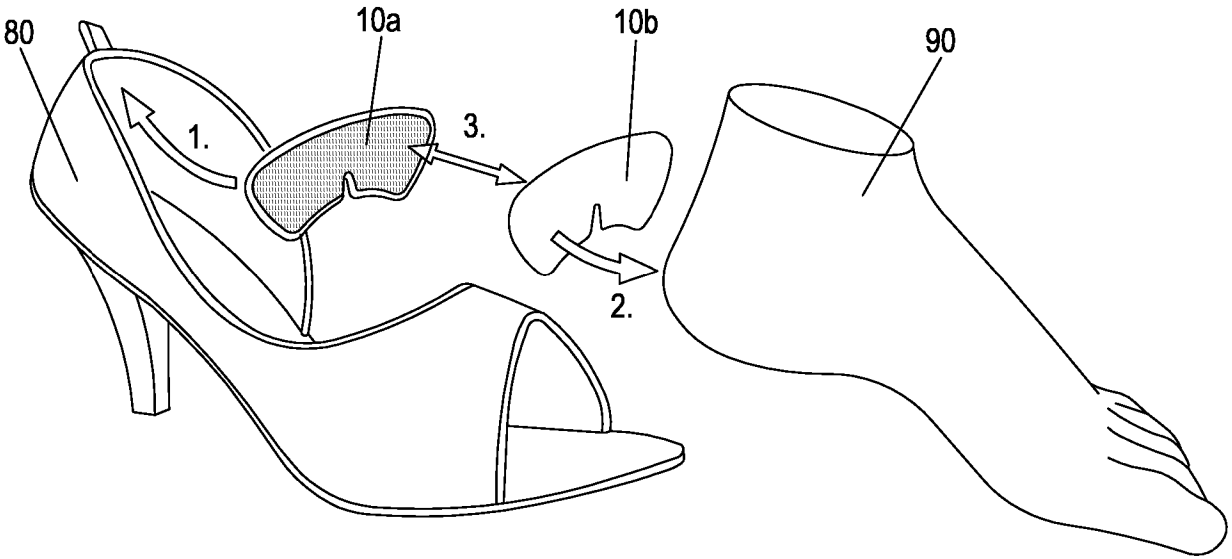
FIG. 7 is an illustration that shows how the insert is used.

FIG. 7 illustrates how the insert of the invention is to be used. The first insert member 10*a* (shown with a Velcro™ hook layer) is applied to the inside of a wearer's shoe 80 as per the arrow labelled "1". The second insert member 10*b* (shown with a Velcro™ loop layer) is applied to the heel of the wearer's foot 90 as per the arrow labelled "2". The user then places their foot 90 into the shoe 80 and the Velcro™ hook layer of the first insert member 10*a* engages the Velcro™ loop layer of the second insert member 10*b*, such that the two layers become attached by way of the hook and loop mechanism as per the arrow labelled "3".

As shown, the shape of the first insert member (a) is arcuate, banana or boomerang-shaped. The second insert member (b) is similarly shaped so as to enable a releasable attachment to form between them.

Although the invention has been particularly shown and described with reference to particular examples, it will be understood by those skilled in the art that various changes in the form and details may be made therein without departing from the scope of the present invention.

The invention claimed is:

1. A footwear insert comprising a first insert member and a second insert member, the first insert member comprising a first surface and a second surface, the first surface opposing the second surface and having a releasable attachment for attaching to an internal portion of footwear, the first insert member comprising a first edge and a second edge, the first edge and the second edge being connected by auriform or arcuate edges, and wherein the second edge is shorter than the first edge;

the second insert member comprising a first surface and a second surface, the first surface opposing the second surface and having a releasable attachment for attaching to a foot, the second insert member comprising a first edge and a second edge, the first edge and the second edge being connected by auriform or arcuate edges, and wherein the second edge is shorter than the first edge;

wherein at least one of the first insert member and the second insert member comprises a notch in substantially the center of the second edge thereof;

wherein, in use, a releasable attachment is formed between the second surface of the first insert member and the second surface of the second insert member.

2. The footwear insert of claim 1 wherein at least one of the releasable attachments comprises an adhesive surface.

3. A kit for a footwear insert, the kit comprising:

a) a first insert member, and b) two or more second insert members, the first insert member comprising a first surface and a second surface, the first surface opposing the second surface and having a releasable attachment for attaching to an internal portion of footwear, the first insert member comprising a first edge and a second edge, the first edge and the second edge being connected by auriform or arcuate edges, and wherein the second edge is shorter than the first edge;

the two or more second insert members each comprising a first and a second surface, the first surface opposing the second surface and having a releasable attachment for attaching to a foot, the two or more second insert members comprising a first edge and a second edge, the first edge and the second edge being connected by auriform or arcuate edges, and wherein the second edge is shorter than the first edge;

wherein at least one of the first insert member and the two or more second insert members comprises a notch in substantially the center of the second edge thereof;

wherein, in use, the second surface of the first insert member and the second surface of each of the second insert members form between them a releasable attachment.

4. The footwear insert of claim 1, wherein in use, the releasable attachments between the first and second insert members are configured to be flexible across the foot to allow the first and second insert members to move relative to each other.

5. The footwear insert of claim 1, wherein the releasable attachment between the first and second insert members comprises a hook-and-loop fastener.

6. The footwear insert of claim 5, wherein the first and/or second insert member comprises a hook layer and/or a loop layer, which only partially covers the second surface of the first and/or second insert member.

7. The footwear insert of claim 5, wherein the first and/or second insert member comprises a gap between the hook layer and/or the loop layer and the perimeter of the first and/or second insert member, in which there are no hooks and/or loops.

8. The footwear insert of claim 5, wherein the second surface of the first insert member comprises hooks, and the second surface of the second insert member comprises loops.

9. The footwear insert of claim 1, wherein, in use, the first and/or second insert member is configured to be flexible across the foot to allow the first and second insert members to move relative to each other.

10. The footwear insert of claim 9, wherein the first and/or second insert member comprises elastomeric material.

11. The footwear insert of claim 1, wherein the first and/or second insert member comprises a resilient material to provide cushioning.

12. The footwear insert of claim 11, wherein the resilient material comprises silicone, or wherein the resilient material comprises a foam or a foam-like material, optionally polyethylene foam.

13. The footwear insert of claim 1, wherein the footwear insert is a heel insert.

14. The footwear insert of claim 1, wherein the first edge and the second edge have a similar circumferential profile.

15. The footwear insert of claim 1, wherein the notch of at least one of first and/or second insert member comprises a V-shaped notch and/or a U-shaped notch.

16. The footwear insert of claim 1, wherein the first and/or second insert member is lobe-shaped or wing-shaped, or wherein the first and/or second insert member comprise one or more lobe-shaped or wing-shaped sections.

17. Use of the footwear insert of claim 1 in footwear for impeding a foot slipping out of a shoe.

18. A kit for a footwear insert, the kit comprising two or more second insert members that are releasably attachable to a first insert member, the first insert member comprising a first surface and a second surface, the first surface opposing the second surface and having a releasable attachment for attaching to an internal portion of footwear, the first insert member comprising a first edge and a second edge, the first edge and the second edge being connected by auriform or arcuate edges, and wherein the second edge is shorter than the first edge;

the two or more second insert members each comprising a first and a second surface, the first surface opposing the second surface and having a releasable attachment for attaching to a foot, the two or more second insert members comprising a first edge and a second edge, the first edge and the second edge being connected by auriform or arcuate edges, and wherein the second edge is shorter than the first edge;

wherein at least one of the first insert member and the two or more second insert members comprises a notch in substantially the center of the second edge thereof;

wherein, in use, the second surface of the first insert member and the second surface of each of the second insert members form between them a releasable attachment.

* * * * *